United States Patent [19]

Gross

[11] 4,143,341

[45] Mar. 6, 1979

[54] DELAY LINE FOR TRAVELING WAVE TUBES, IN PARTICULAR TO THE AMPLIFICATION OF MM WAVES

[75] Inventor: Franz Gross, Munich, Fed. Rep. of Germany

[73] Assignee: Siemens Aktiengesellschaft, Berlin & Munich, Fed. Rep. of Germany

[21] Appl. No.: 805,641

[22] Filed: Jun. 13, 1977

[30] Foreign Application Priority Data

Aug. 13, 1976 [DE] Fed. Rep. of Germany ..... 2636633

[51] Int. Cl.[2] ..... H01J 25/34; H01J 23/24; H01P 5/08

[52] U.S. Cl. ..... 333/157; 315/3.5; 315/3.6; 333/33

[58] Field of Search ..... 333/31 A, 33, 98 R, 333/31 R; 315/3.5, 3.6

[56] References Cited

U.S. PATENT DOCUMENTS 3,466,576 9/1969 Bert ..... 333/33 X 4,066,927 1/1978 Gross ..... 333/31 A

*Primary Examiner*—Alfred E. Smith
*Assistant Examiner*—Marvin Nussbaum
*Attorney, Agent, or Firm*—Hill, Gross, Simpson, Van Santen, Steadman, Chiara & Simpson

[57] ABSTRACT

A delay line for traveling wave tubes, in particular for the amplification of mm waves, has a wave guide which is provided with outward-leading transverse walls each of which has a central electron beam opening and at least one coupling opening and which form a line cell with the adjacent transverse wall. The delay line contains two portions having a different constant delay for the line wave, where the delay of the front line portion, considered in the direction of the electron beam, is lower than the delay of the rear line portion. A transition section is arranged between these two portions for matching and comprises a single matching cell in which at least one of the two transverse walls of the matching cell carries at least one matching pin which projects into the interior of the cell.

10 Claims, 3 Drawing Figures

DELAY LINE FOR TRAVELING WAVE TUBES, IN PARTICULAR TO THE AMPLIFICATION OF MM WAVES

BACKGROUND OF THE INVENTION

1. Field of the Invention

The present invention relates to a delay line for traveling wave tubes, in particular for the amplification of mm waves, in which a wave guide is provided with outward-leading transverse walls, each of which have a central electron beam opening and at least one coupling opening and which form a line cell with the adjoining transverse wall, and which contains two portions having different constant delays for the line wave, where the delay of the front line portion, as viewed in the direction of the electron beam, is less than the delay of the rear line portion, and more particularly to such an arrangement wherein there is provided a transition section arranged between the two portions.

2. Description of the Prior Art

A delay line of the general type set forth above is described, for example, in the publication "Microwave System News," June/July 1974, Pages 64C—64F.

Inasmuch as an optimum transition of energy between the electron beam and the accompanying line wave is dependent upon a specific difference between the beam speed and the wave speed ("synchronism condition"), and as, furthermore, the electron beam which constantly emits energy becomes increasingly slower toward the end of the line, as is known a high tube efficiency is achieved if the delay of the line is increased toward its output in accordance with the speed loss of the electron beam. A measure of this type, which is also referred to as "resynchronization by speed tapering" is described in detail, for example, in the general articles by M. K. Scherba, in the publication "Microwaves", July 1973, Pages 46–51, and J. T. Mendel in the "Proceedings of the IEEE", Vol. 61, No. 3, March 1973, Pages 280–298, in particular at Page 296, left-hand column, paragraph 3 to Page 297 right-hand column, paragraph 1.

In the type of delay line referred to in the introduction, the speed matching is achieved in accordance with a principle explained by reference to a coil in FIG. 2*a* of the above-quoted publication "Microwaves": two line portions having differing, constant phase speed connected to one another over an intermediate portion which comprises a plurality of line periods, and which constantly converts the phase speeds one to another. In a coupled-cavity line, this intermediate portion must consist of a number of differently designed line cells, which lead to incompatibilities; the differing geometric patterns of the cells complicate their production. Furthermore, even with the most accurate calculations, and the most careful operation, the cell sequence can only completely fulfill the requirements to which it is subject (speed matching with a surge impedance transformation which is as low-reflective as possible, and maintaining a high degree of amplification), as the ideal, constant transitions must be approximated by means of stepped functions. In particular, correction of production-related mismatchings, for example due to dimensioning variations of individual line discs, prove extremely expensive and complicated. This is one of the reasons why recently the "voltage jump" technique has been recommended in place of the speed tapering technique, as being more practical for lines of the coupled-cavity type, in particular in the mm wave range, although the subsequent acceleration of the electron beam produces insulation problems in this case. In this connection, one may take reference to the two aforementioned articles of Scherba and Mendel.

SUMMARY OF THE INVENTION

The object of the present invention is to modify a line of the type mentioned above, in such a way that it can be produced more economically and so that matching errors, resulting from tapering, can be corrected easily and with good results, without involving efficiency losses.

In order to realize this object, the invention proposes three alternative embodiments. In the first embodiment, the transition section comprises a single matching cell in which at least one of the two transverse walls of the matching cells bears at least one matching pin which projects into the interior of the cell.

In a second embodiment, the transition section comprises a single matching cell in which at least one of the two transverse walls of the cell is provided with at least one slot and/or one recess.

In another embodiment, the transition section comprises a single matching cell in which the transverse dimensioning of the cells differs from that of the remaining line cells.

All three proposed embodiments are based on the principle that one no longer provides a gradual transition which is as constant as possible between the line portions having different delays, as heretofore practiced, but instead one deliberately permits a jump and at the jump point provides a transformation of the various surge impedances, as reflection-free as possible, by means of suitable compensation techniques. Starting with this realization, the different embodiments each provide measures to bring out the desired matching, i.e. fundamentally the requisite reactive component of the surge impedance in the matching cell, with the aid of simple means. In the embodiment set forth first above (the use of matching pins) there is a particular advantage that the mis-matchings can be eliminated simply by varying the pin length, and therefore no special production is required for the matching cell. However, the selection of slots and/or recesses in the transverse walls of the matching cells (the second discussed embodiment), and even a variation of the transverse dimensions of the matching cell (the third discussed embodiment) lead to considerable production simplications.

The tapering, as provided in accordance with the present invention, furthermore facilitates a rapid correction of matching errors in a few steps, as it is only necessary to alter a single parameter in a single cell. In fact, experiments have indicated that the matching quality which can be achieved withstands any comparison with values of a multi-cell transition, and that in a delay line constructed in accordance with the invention even the amplification factor is higher than in a line of equal length exhibiting a constant transition.

The advantages of the resynchronization provided by the present invention come into play, in particular, when one is concerned with a line having ring-shaped transverse diaphragms between the individual transverse walls, a construction of the type set forth in the German Pat. No. 18 04 959. In this case, it is sufficient to provide the transverse walls with the matching pins, or slots, or recesses, or to vary their inner diameters.

If it is decided to use matching pins, metallic pins should be used if possible. This is because metallic pins do not affect the taper matching if they are to be vaporized during the operation of the tube.

BRIEF DESCRIPTION OF THE DRAWING

Other objects, features and advantages of the invention, its organization, construction and operation will be best understood from the following detailed description, taken in conjunction with the accompanying drawing, on which.

DESCRIPTION OF THE PREFERRED EMBODIMENTS

Figure 1:
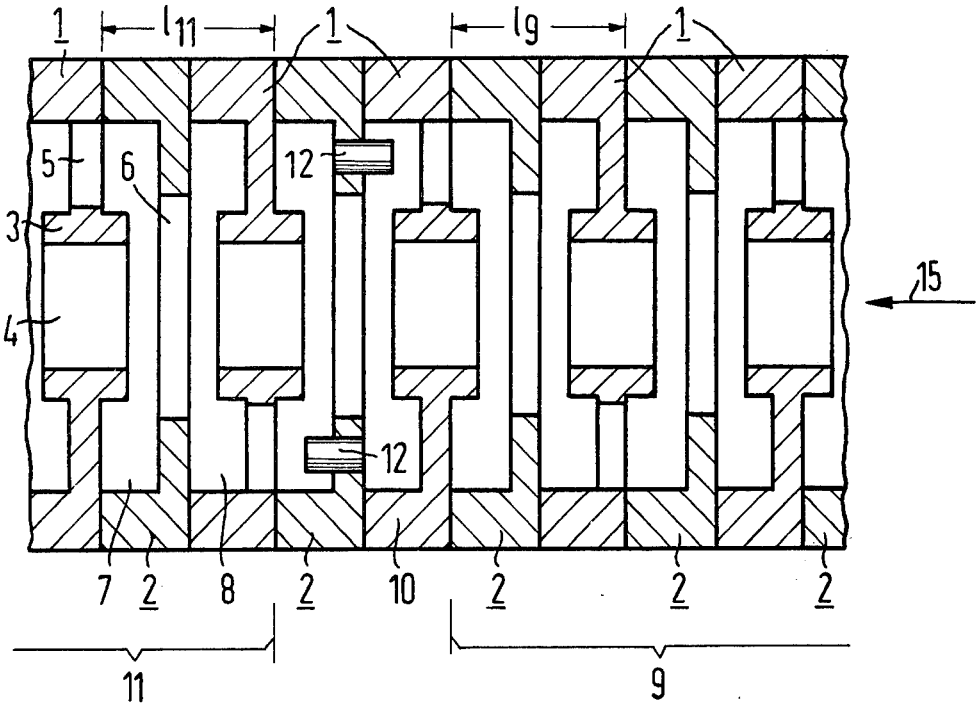
FIG. 1 is a longitudinal sectional view of a portion of a delay line constructed in accordance with the present invention.

Referring to FIG. 1, a delay line is illustrated for a traveling wave tube which operates, for example, in the frequency range from 20 to 40 GHz, and which comprises a plurality of sections which are separated from one another in respect of high frequencies. In FIG. 1 only the output end section is illustrated, and in fact the part thereof containing the matching cell.

The line comprises transverse walls 1 and transverse diaphragms 2 in an alternate series in the electron beam direction which is indicated by the arrow 15. The transverse walls in the transverse diaphragms are provided with respective continuous flanges, and are thus separated from one another without the use of additional spacers. Walls and diaphragms consist of copper and are soldered to one another to form a solid block ("stack line"). At a central point, each transverse wall contains a beam tube 3 having an electron beam opening 4 and a coupling opening 5. The transverse diaphragms also each have a central opening 6. Consecutive transverse walls are each rotated by 180° relative to one another and together form a line cell 7, in each case divided by a transverse diaphragm.

The line section illustrated in FIG. 1 contains two portions which are separated from one another by a single cell, a matching cell 8. One portion lines in front of the matching cell, considered in the electron beam direction, and the other portion lies to the rear of the matching cell, also considered in the same direction. These line portions are identified as the portions 9 and 11, respectively. Each portion possesses line cells of identical design, although the cells of the front portion 9 have a longer length than the cells of the rear portion 11, i.e. $l_9 > l_{11}$, so that the phase speed of the line wave is constant in both portions, and is higher in the portion 9 than in the portion 11. In the schematic representation of FIG. 1, the differences in line period have not been taken into consideration. The length of the matching cell can correspond to one of the two lengths $l_9$, $l_{11}$.

In the exemplary embodiment illustrated in FIG. 1, the transverse diaphragm of the matching cell, that is the diaphragm 10, is provided with two matching pins 12. These pins are each inserted into that region of the diaphragm which lies opposite the coupling opening of the transverse wall, and project toward these coupling openings. Like the walls in the diaphragms, the pins also consist of copper.

Figure 2:
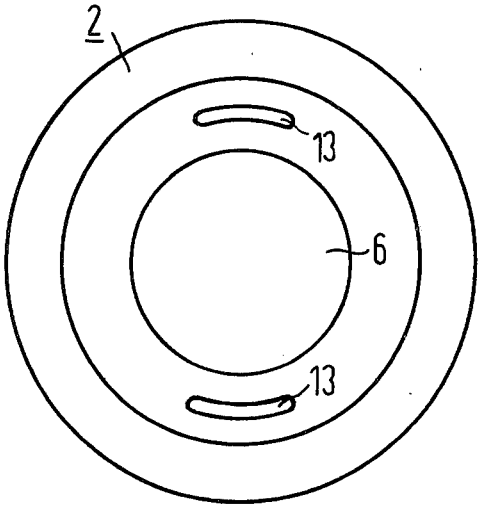
FIG. 2 is a rear plan view of transverse walls of a matching cell illustrating a second embodiment of the invention.

The embodiment set forth in FIG. 2 differs from the above-described arrangement simply in that the transverse diaphragm is provided with slots 13 extending in the direction of circulation, instead of the matching pins.

Figure 3:
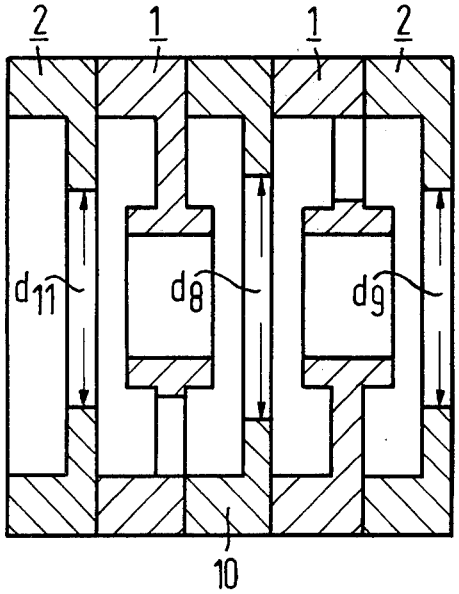
FIG. 3 is a sectional view, similar to FIG. 1, illustrating a third embodiment of the invention in which a matching cell has different dimensions than the remaining line cells.

Instead of introducing slots into the transverse diaphragm, the inner diameter of the diaphragm could be designed to deviate from the inner diameter of the other transverse diaphragms, as is the case in the embodiment illustrated in FIG. 3. In this embodiment, the inner diameter of the matching diaphragm ($d_8$) is greater than the inner diameters of the other diaphragms, which are equal to one another ($d_9$ in the portion 9 and $d_{11}$ in the portion 11).

The matching errors resulting from tapering may be eliminated as follows.

First of all, the two line portions are produced, whereupon a matching cell is provided, for example, with matching pins of a specific length, and is inserted between the two portions, and the line thus obtained is measured. Depending upon the measurement results obtained, the pin length is varied to be such that adequate matching values can be set. The pins are then secured and the matching cell is fixed to the remainder of the line.

For further details of production, one may refer to the German Pat. application No. P 25 25 845.

The present invention is not limited to the represented exemplary embodiments. Therefore, the proposed individual measures can be combined in arbitrary combinations, and other constructive measures can also be taken, to vary the reactive component of the surge impedance within the matching cell in a desired manner, for example, to provide the transverse diaphragm or the transverse walls with radial slots or recesses. Apart from this, the proposed theory can also be employed in other delay lines of the coupled-cavity type.

Although I have described my invention by reference to particular illustrative embodiments thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. In a traveling wave tube delay line wherein a wave guide is provided with transverse walls each including a central electron beam opening and at least one coupling opening which, together with an adjoining transverse wall, form a resonant cavity line cell, and wherein in the direction of the electron beam a first line portion encountered by the electron beam has a lower delay than the delay of a subsequent line portion, the cavities of each of said portions being mutually identical, the improvement in combination therewith comprising: a transition section between said first and subsequent portions comprising a single resonant cavity matching cell including a pair of transverse walls of which at least one thereof includes compensating means to substantially eliminate matching errors.

2. The improved traveling wave tube delay line according to claim 1, wherein at least one of said transverse walls of said matching cell includes at least one slot.

3. The improved traveling wave tube delay line according to claim 1, wherein at least one of said transverse walls of said matching cell includes at least one recess therein.

4. The improved traveling wave tube delay line according to claim 1, wherein the transverse dimension of said matching cell is different from that of the other line cells.

5. The improved traveling wave tube delay line according to claim 1, comprising a ring-shaped transverse diaphragm in each of said line cells, said transverse diaphragm of said matching cell including a portion having material removed therefrom.

6. The improved traveling wave tube delay line according to claim 1, comprising:

a ring-shaped transverse diaphragm in each of said line cells, said diaphragm of said matching cell having an inner diameter which is different from that of the other diaphragms.

7. The improved traveling wave tube delay line according to claim 1, wherein said compensating means comprises:

at least one matching pin which projects into the interior of said matching cell.

8. The improved traveling wave tube delay line according to claim 7, wherein said matching pin consists of metal.

9. The improved traveling wave tube delay line according to claim 7, wherein each of said cells comprises a transverse diaphragm and said transverse diaphragm of said matching cell carries said matching pin.

10. The improved traveling wave tube delay line according to claim 7, wherein said cells comprises diametrically alternating coupling openings and said transverse wall of said matching cell carries two of said matching pins located opposite adjacent ones of said alternate coupling openings.

* * * * *